US009650828B1

(12) United States Patent
Weston

(10) Patent No.: US 9,650,828 B1
(45) Date of Patent: May 16, 2017

(54) VARIABLE SCREENS

(71) Applicant: Mark William Weston, Bradenton, FL (US)

(72) Inventor: Mark William Weston, Bradenton, FL (US)

(73) Assignee: University of South Florida, Tampa, FL (US)

( * ) Notice: Subject to any disclaimer, the term of this patent is extended or adjusted under 35 U.S.C. 154(b) by 69 days.

(21) Appl. No.: 14/523,067

(22) Filed: Oct. 24, 2014

Related U.S. Application Data

(60) Provisional application No. 61/895,114, filed on Oct. 24, 2013.

(51) Int. Cl.
*E06B 9/00* (2006.01)
*E06B 9/24* (2006.01)

(52) U.S. Cl.
CPC ..... *E06B 9/24* (2013.01); *E06B 2009/2423* (2013.01)

(58) Field of Classification Search
CPC ..... E06B 2009/2447; E06B 2009/2435; E06B 2009/2482; E06B 2009/2423; E06B 2009/2452; F24F 13/08; F24F 13/0182; F24F 13/12; F24F 13/10
USPC ..... 454/303, 295–299, 121, 155; 160/352
See application file for complete search history.

(56) References Cited

U.S. PATENT DOCUMENTS 2,140,049 A * 12/1938 Grauel ..... E06B 9/34 160/121.1
2,205,661 A * 6/1940 Kraft ..... B60K 11/085 160/237
2,705,687 A * 4/1955 Petterson ..... C10B 49/00 128/112.1
3,065,785 A * 11/1962 Taber ..... A47H 23/04 160/237
3,197,820 A * 8/1965 Au Claire, Sr. ..... E06B 9/01 428/116
3,264,972 A * 8/1966 Averill ..... F24F 13/068 454/297
3,373,275 A * 3/1968 High ..... B29D 11/00 362/330
3,403,614 A * 10/1968 Carnes ..... F24F 13/078 165/54
3,444,919 A * 5/1969 Karoll ..... E06B 9/24 160/184
3,461,791 A * 8/1969 Beyer ..... F24F 13/12 454/155

(Continued)

FOREIGN PATENT DOCUMENTS

CL WO 2015149193 A1 * 10/2015 ..... B31D 3/023
FR WO 0212648 A1 * 2/2002 ..... E04B 7/166

*Primary Examiner* — Katherine Mitchell
*Assistant Examiner* — Johnnie A Shablack
(74) *Attorney, Agent, or Firm* — Thomas I Horstemeyer, LLP

(57) ABSTRACT

In one embodiment, a variable screen includes a first panel including elongated slats having a fixed end and a free end, the slats being flexible so that they can bend without breaking, and a second panel associated with the first panel, the second panel including elongated slots that align with the slats of the first panel, wherein the free ends of the slats are attached to the second panel near ends of the slots and wherein relative movement of the panels causes the slats to bow outward to enable light or air to pass through the slots.

18 Claims, 7 Drawing Sheets

(56) References Cited

U.S. PATENT DOCUMENTS 3,528,359 A * 9/1970 Sand ..... F24F 13/12 454/324
3,948,155 A * 4/1976 Hedrick ..... F24F 13/068 454/296
4,105,724 A * 8/1978 Talbot ..... B01J 19/30 261/112.1
4,915,021 A * 4/1990 Soethout ..... F24F 13/075 3/75
5,120,273 A * 6/1992 Lin ..... E06B 7/02 454/195
5,155,936 A * 10/1992 Johnson ..... E06B 7/06 160/222
5,664,613 A * 9/1997 Jelic ..... E06B 9/30 160/121.1
5,672,406 A * 9/1997 Challis ..... A61F 13/023 383/102
5,967,788 A * 10/1999 Udoh ..... G09B 23/04 428/136
6,161,607 A * 12/2000 de Kimpe ..... E06B 9/40 160/121.1
6,575,222 B2 * 6/2003 Corey ..... B29C 66/437 160/121.1
7,517,279 B2 * 4/2009 Kober ..... B60H 1/34 454/152
7,584,777 B2 * 9/2009 Hoberman ..... E06B 9/24 160/161
7,686,060 B2 * 3/2010 Anthony ..... E06B 9/34 160/116
7,913,740 B2 * 3/2011 Chen ..... A47H 23/04 16/87.2
8,256,488 B2 * 9/2012 Ruggles ..... E04B 2/74 160/113
8,272,931 B2 * 9/2012 Kogler ..... B60H 1/3414 454/121
8,353,326 B2 * 1/2013 Chang ..... D03D 1/007 139/383 R
8,550,887 B2 * 10/2013 Walters ..... B60K 11/085 454/155
8,615,970 B2 * 12/2013 Hoberman ..... E04B 1/86 160/187
8,640,393 B2 * 2/2014 Claerhout ..... E04B 2/88 160/218
8,919,418 B2 * 12/2014 Carvallo ..... E06B 9/264 160/180
8,955,555 B2 * 2/2015 Cha ..... D03D 11/02 139/11
8,960,259 B2 * 2/2015 Weston ..... E06B 9/06 160/23.1
9,127,497 B2 * 9/2015 Safarik ..... E06B 9/26
9,322,165 B2 * 4/2016 Luhtala ..... E04B 1/84
2004/0041433 A1 * 3/2004 Sturt ..... B60J 7/003 296/97.3
2005/0239389 A1 * 10/2005 Jahn ..... B60H 1/3414 454/127
2007/0184238 A1 * 8/2007 Hockaday ..... B32B 7/00 428/98
2007/0237923 A1 * 10/2007 Dorsy ..... E04C 2/08 428/136
2010/0126675 A1 * 5/2010 Jelic ..... A47H 23/04 160/168.1 R
2011/0259529 A1 * 10/2011 Clear ..... A47H 23/06 160/7
2013/0111814 A1 * 5/2013 Drohan ..... E06B 3/6722 49/82.1
2013/0163062 A1 * 6/2013 Yang ..... E06B 9/24 359/228
2015/0087217 A1 * 3/2015 Switzer ..... B60H 1/248 454/76
2016/0053531 A1 * 2/2016 Hsieh ..... G02B 5/0278 359/599

* cited by examiner

VARIABLE SCREENS

CROSS-REFERENCE TO RELATED APPLICATION(S)

This application claims priority to U.S. Provisional Application Ser. No. 61/895,114, filed Oct. 24, 2013, which is hereby incorporated by reference herein in its entirety.

BACKGROUND

Solar shading is an essential component to good passive energy design for buildings. Traditionally, solar design has come in the form of static shading devices applied to building openings or in building forms that accommodate such strategies in their basic shape and orientation. New technologies, however, have created adaptive solar shading that responds to lighting conditions, time of day, and the presence of building occupants. Although active shading systems currently exist, they tend to rely on complex mechanical solutions to architectural problems. It would therefore be desirable to have alternative systems that provide solar shading.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable to have alternative systems that provide solar shading. Disclosed herein are variable screens that can be used to control the passage of light and/or air. In some embodiments, the variable screens comprise a first panel including elongated slats and a second panel including elongated slots that correspond to that slats of the first panel. When the free ends of the slats of the first panel are affixed to the second panel so that the slats overlie or fill the slots, relative movement (e.g., parallel sliding) between the panels causes the slats to bow in one direction or another so as to enable light and/or air to pass through the slots of the second panel.

In the following disclosure, various specific embodiments are described. It is to be understood that those embodiments are example implementations of the disclosed inventions and that alternative embodiments are possible. All such embodiments are intended to fall within the scope of this disclosure.

Figure 1:
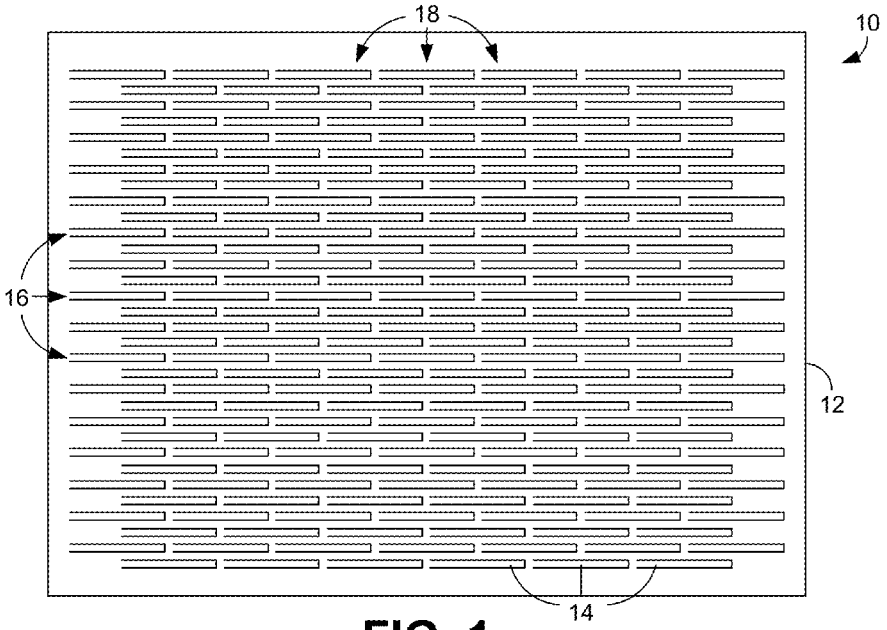
FIG. 1 is a top view of a first panel of an embodiment of a variable screen.
Figure 2:
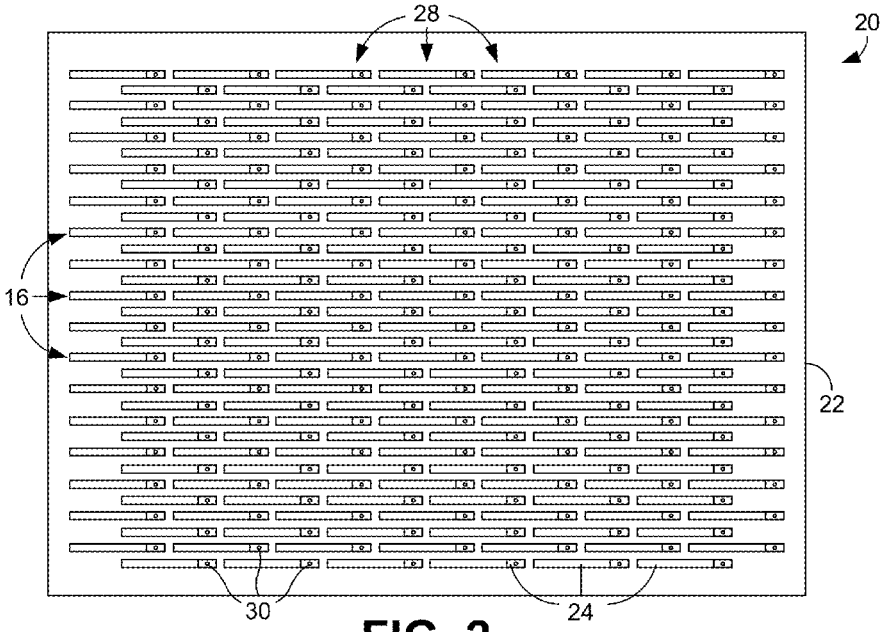
FIG. 2 is a top view of a second panel of the variable screen.

FIGS. 1 and 2 illustrate two panels that can be used together to form a variable screen. Beginning with FIG. 1, a first (e.g., top) panel 10 comprises a generally rectangular and planar substrate 12 that comprises a plurality of small rectangular elongated slats 14. The material used to form the substrate 12 can depend upon the intended application. In embodiments in which the entire panel 10 is made out of the same material, the material can be a flexible, shape-memory material so as to enable the slats 14 to bend from an initial (e.g., flat) orientation and later return to the initial orientation. In embodiments in which the body of the panel 10 is made of first material and the slats 14 are made of a different material, the body need not be made of the flexible, shape-memory material. In some embodiments, the panel 10 is made of one or more of wood, plastic, and metal. In some embodiments, the panel 10 can be a composite material comprising multiple materials.

In some embodiments, each slat 14 is created by forming a narrow continuous U-shaped slot through the substrate 12 (from its top surface through the substrate to its bottom surface) so as to produce a slat having a proximal fixed end and a distal free end. As indicated in FIG. 1, the elongated slats 14 of the first panel 10 are aligned across the length of the panel in parallel rows 16 and are aligned across the width of the panel in parallel columns 18.

Referring next to FIG. 2, a second (e.g., bottom) panel 20 also comprises a generally rectangular and planar substrate 22, which can have dimensions similar to those of the panel 10. Instead of elongated rectangular slats, however, the panel 20 comprises a plurality of small rectangular elongated slots 24 (i.e., elongated rectangular openings). The material used to form the substrate 22 can also depend upon the intended application but, generally speaking, the material does not need to be flexible because the second panel 20 does not bend during use. In some embodiments, the panel 20 is made of one or more of wood, plastic, and metal. In some embodiments, the panel 20 can be a composite material comprising multiple materials.

Like the elongated slats 14 of the first panel 10, the elongated slots 24 of the second panel 20 are aligned across the length of the panel in parallel rows 26 and are aligned across the width of the panel in parallel columns 28. Furthermore, as can be appreciated through comparison of FIGS. 1 and 2, the slots 24 have a layout that is similar to the layout of the slats 14 so that, when the two panels 10, 12 are combined (by placing the first panel 10 on top of the second panel 20), each slot of the second panel aligns with a corresponding slat of the first panel. Moreover, the configurations and dimensions of the slots 24 can be substantially similar to the configurations and dimensions of the slats 14, although the slats may be slightly longer than the slots to facilitate the attachment to the second panel 20 or may be slightly more narrow than the slots to facilitate passage of the slats through the slots (see below).

In some embodiments, attachment means 30 are provided at one end of each slot 24 to facilitate attachment of a corresponding slat 14 when the panels 10, 12 are combined. More particularly, attachment means 30 can be provided at the ends of the slots 24 to correspond with the free ends of the slats 14 when the panels 10, 12 are combined.

Figure 3A:
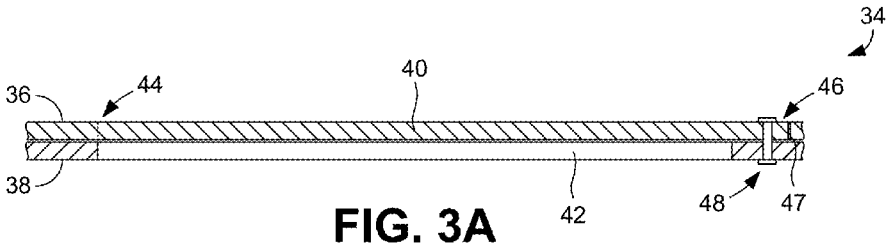
FIGS. 3A and 3B are partial cross-sectional side views of an embodiment of a variable screen illustrating a first example configuration and mode of operation for slats of the screen.
Figure 3B:
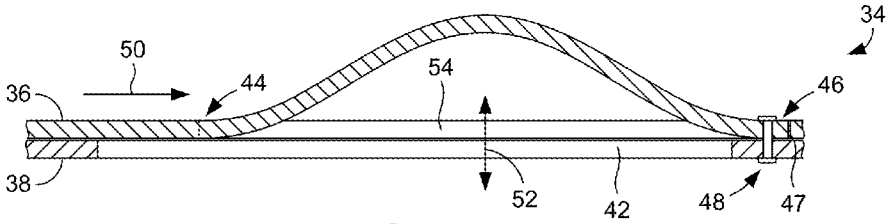

FIGS. 3-5 illustrate examples of variable screens having configurations similar to that described above. Beginning with FIGS. 3A and 3B, shown is a first variable screen 34 in partial view. The screen 34 generally comprises a first (top) panel 36 and a second (bottom) panel 38, which is parallel to the first panel. As indicated in the figures, the panels 36, 38 are placed in close proximity to each other. For example, the first panel 36 can be positioned directly on top of the second panel 38. The first panel 36 comprises slats 40 and the bottom panel 38 comprises corresponding slots 42 (only one slat 40 and one slot 42 shown in the figures). The slat 40 overlaps the slot 42 so that its proximal fixed end 44 and its distal free end 46 are each positioned near an end of the slot. The free end 46 of the slat 40 is further attached to an inner surface 47 of the second panel 38 (i.e., the surface facing the first panel 36) near one end of the slot 42 with fastening means. In the illustrated embodiment, the fastening means comprise a mechanical fastener 48 in the form of a fastening pin.

FIG. 3A illustrates the variable screen 34 in an initial, unactuated state in which the slat 40 is flat and covers the slot 42 so as to limit the amount of light and/or air that can pass through the screen 34. FIG. 3B shows the screen 34 in an actuated state in which the first panel 36 has been moved (e.g., slid) relative to the second panel 38 in the direction indicated with arrow 50. Such movement can be performed manually or by a drive mechanism (not shown) that is adapted to slide the first panel 36 relative to the second panel 38 in a frame (not shown) in which each panel is mounted. When this occurs, the fixed end 44 of the slat 40 is moved closer to the free end 46 of the slat 40 so as to cause the medial portion of the slat to bow outward from the screen 34. This bowing enables light and/or air to pass through the screen 34 in the directions indicated by arrow 52. As is apparent from FIG. 3B, bowing of the slat 40 also opens a slot 54 in the first panel 36 that is aligned with the slot 42 of the second panel 38.

Although bowing of the slat 40 has been described as occurring responsive to moving the first panel 36 relative to the second panel 38, it is noted that any relative movement between the panels that causes the fixed end 44 of the slat to move closer to the free end 46 of the slat, or vice versa, will cause the bowing effect and actuation of the variable screen 34. Accordingly, the first panel 36 can be moved while the second panel 38 is fixed, the second panel can be moved while the first panel is fixed, or both panels can be simultaneously moved relative to each other. It is further noted that, although the slat 40 is shown bowing outward in a first (upward) direction, the slat can, alternatively, bow outward in a second (downward) direction through the slot 42 in the second panel 38, assuming the slat is more narrow than the slot. In some embodiments, the direction in which the slat 40 bows can be controlled by the manner in which the slat 40 is attached to the second panel 38. In the example of FIGS. 3A and 3B, mounting the slat 40 to the inner surface 47 of the second panel 38 may result in the slat naturally bowing in the direction indicated in FIG. 3B. In other embodiments, the direction in which the slat 40 bows can be controlled by biasing the slat to favor one direction or the other. For example, the first panel 36 can be rolled for a period of time prior to formation of the screen 34 so that its slats 40 tend to bend in a particular direction.

Figure 4A:
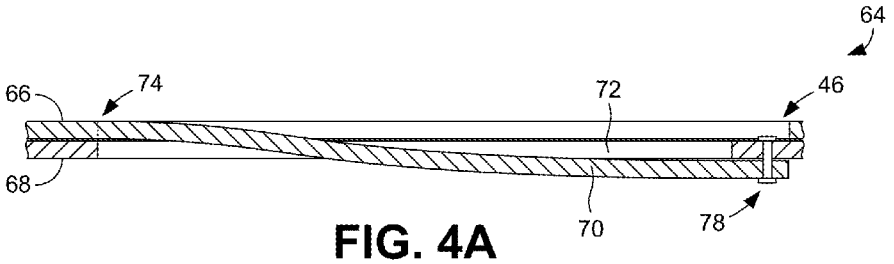
FIGS. 4A and 4B are partial cross-sectional side views of an embodiment of a variable screen illustrating a second example configuration and mode of operation for slats of the screen.
Figure 4B:
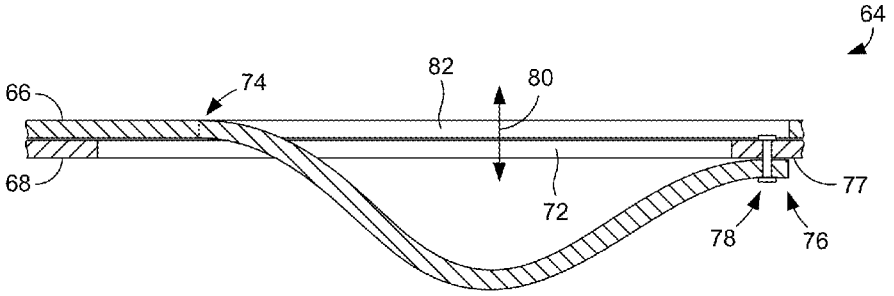

FIGS. 4A and 4B illustrate a second variable screen 64 in partial view. Like the screen 34, the screen 64 generally comprises a first (top) panel 66 and a second (bottom) panel 68. The first panel 66 includes slats 70 and the second panel 68 includes corresponding slots 72 (only one slat 70 and one slot 72 shown in the figures). In this embodiment, however, the free end 76 of the slat 70 is attached to an outer surface 77 of the second panel 68 (i.e., the surface facing away from the first panel 66) near one end of the slot 72 with a mechanical fastener 78. Accordingly, the slat 70 passes through the slot 72 so that it obstructs light and/or air that would otherwise freely pass through the slot.

FIG. 4B shows the screen 64 in an actuated state in which relative movement has occurred between the first panel 66 and the second panel 68 such that the proximal fixed end 74 of the slat 70 has been moved closer to the distal free end 76 of the slat. This has caused the slat 70 to bow outward to enable light and/or air to pass through the screen 64 in the directions indicated by arrow 80. As is apparent from FIG. 4B, bowing of the slat 70 has also opened a slot 82 in the first panel 66 that is aligned with the slot 72 of the second panel 68. In this case, the slat 70 has bowed in a different direction (i.e., downward) than that shown in FIG. 3B. This can be due to the free end 76 of the slat 70 being attached to the outer surface 77 of the bottom panel 68.

Figure 5A:
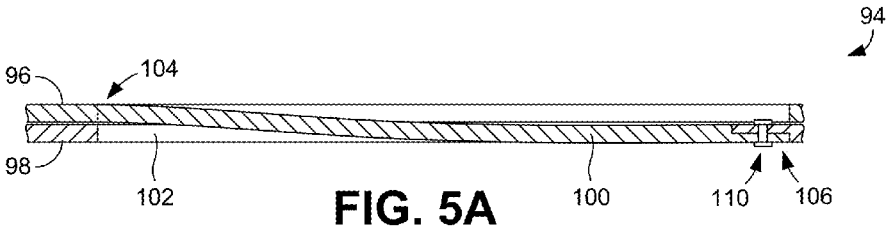
FIGS. 5A and 5B are partial cross-sectional side views of an embodiment of a variable screen illustrating a third example configuration and mode of operation for slats of the screen.
Figure 5B:
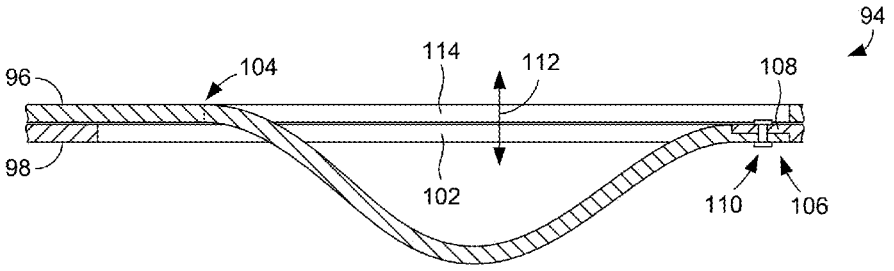

FIGS. 5A and 5B illustrate a third variable screen 94 in partial view. Like the previously described screens, the screen 94 generally comprises a first (top) panel 96 and a second (bottom) panel 98. The first panel 96 includes slats 70 and the second panel 98 includes corresponding slots 102 (only one slat 100 and one slot 102 shown in the figures). In this embodiment, however, the free end 106 of the slat 100 is attached to a mounting tab 108 that is positioned at the end of the slot 102. In the illustrated embodiment, the tab 108 is positioned within the slot 102 at its end. Assuming the free end 106 of the slat 100 and the tab 108 are thinner than the panels 96, 98, the slat will not extend beyond the outer surfaces of the panels. As shown in FIGS. 5A and 5B, the free end 106 can be attached to the mounting tab 108 with a mechanical fastener 110. As is apparent in FIG. 5A, the slat 100 passes into the slot 102 so that the slat obstructs light and/or air that would otherwise freely pass through the slot.

FIG. 5B shows the screen 94 in an actuated state in which relative movement has occurred between the first panel 96 and the second panel 98 such that the fixed end 104 of the slat 100 has been moved closer to the free end 106 of the slat. This has caused the slat 100 to bow outward to enable light and/or air to pass through the screen 94 in the directions indicated by arrow 112. As is apparent from FIG. 5B, bowing of the slat 100 has also opened a slot 114 in the top panel 96 that is aligned with the slot 102 of the bottom panel 98. In this case, the slat 100 has bowed in the same direction (i.e., downward) as shown in FIG. 4B.

Figure 6:
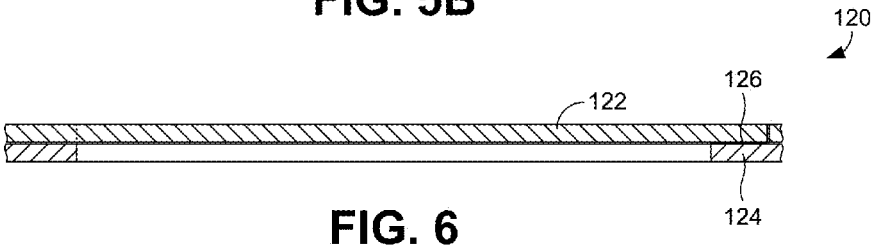
FIG. 6 is a partial cross-sectional side view of an embodiment of a variable screen illustrating a first alternative slat attachment scheme.
Figure 7:
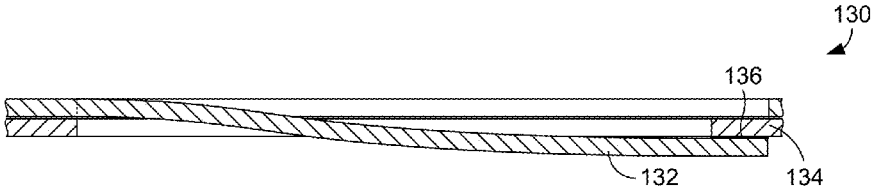
FIG. 7 is a partial cross-sectional side view of an embodiment of a variable screen illustrating a second alternative slat attachment scheme.
Figure 8:
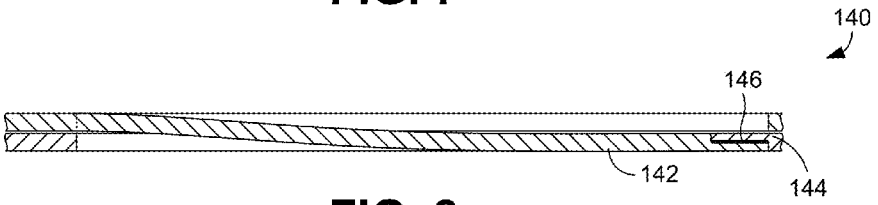
FIG. 8 is a partial cross-sectional side view of an embodiment of a variable screen illustrating a third alternative slat attachment scheme.

In each of FIGS. 3-5, the slats of the first panel have been illustrated being attached to the second panel with mechanical fasteners. Alternative fastening means can be used. FIGS. 6-8 show variable screens 120, 130, and 140, respectively, that are similar to the variable screens 34, 64, and 94 shown in FIGS. 3-5 in which the slats 122, 132, and 142 have been attached to their respective second panels 124, 134, and 144 with adhesive material 126, 136, and 146.

Figure 9:
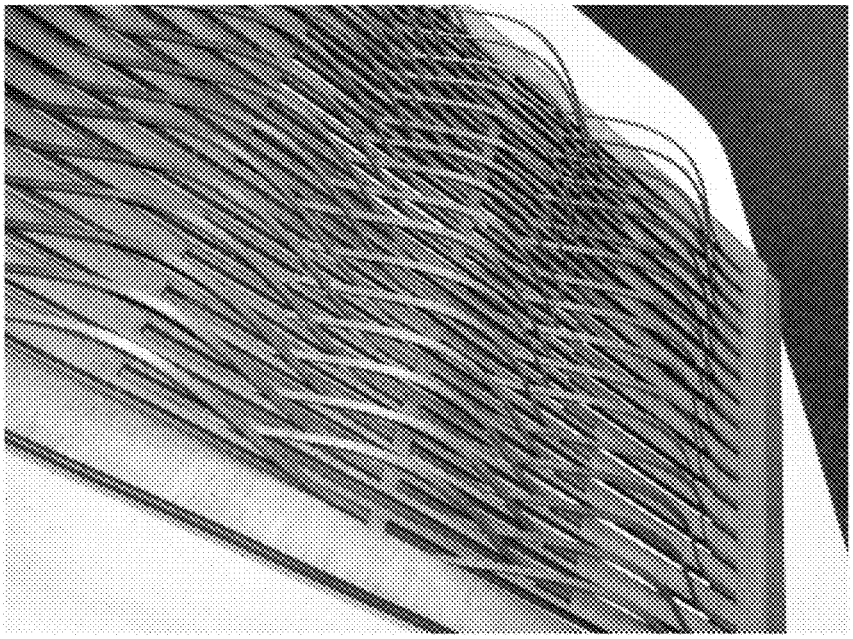
FIG. 9 is a photograph of a fabricated variable screen illustrating the bowing of slats of the screen.

FIG. 9 illustrates an example variable screen that was fabricated using the principles described above. In this embodiment, the panels of the screen were made of wood.

Figure 10:
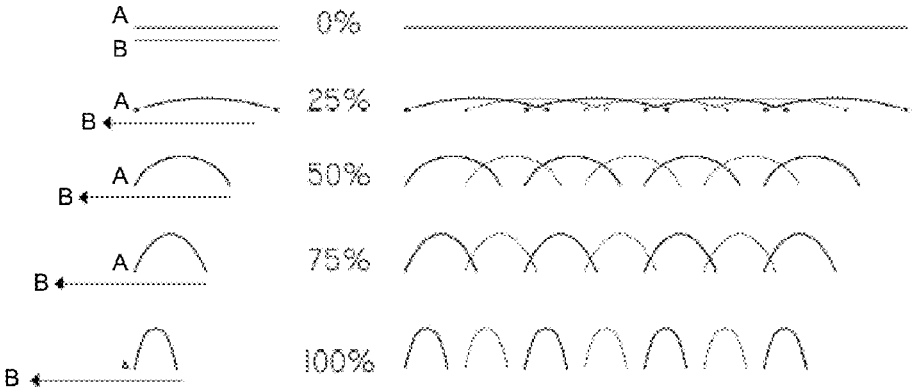
FIG. 10 is a schematic diagram that correlates relative position of first and second panels of a variable screen with bowing of slats.

The degree to which a variable screen of the type disclosed herein can be opened, and therefore the extent to which light and/or air can pass through the screen, is proportional to the extent to which the panels are moved relative to each other. FIG. 10 illustrates the correlation between the relative positions of two panels (Panels A and B) of a variable screen with bowing of the slats. As is apparent from FIG. 10, when the panels have not been moved relative to each other, the slats do not bow outward. However, as the panels are relatively moved to a greater and greater degree, the extent and distance to which the slats bow outward becomes greater and greater.

Variable screens such as those described above can be used in various applications. In one such application, the screens can be used as adaptive devices for precise passive lighting control. In particular, the screens can create controlled, diffused lighting conditions for interior and exterior spaces, while possessing an intensely saturated material quality. In some embodiments, the screens can be used to create a manifold light shelf condition in which the screen reflects diffused light toward the ceilings of interior architectural spaces. The light shelf can be further accentuated by adding reflectors to the slots, which unfurl as the screen opens.

Figure 11:
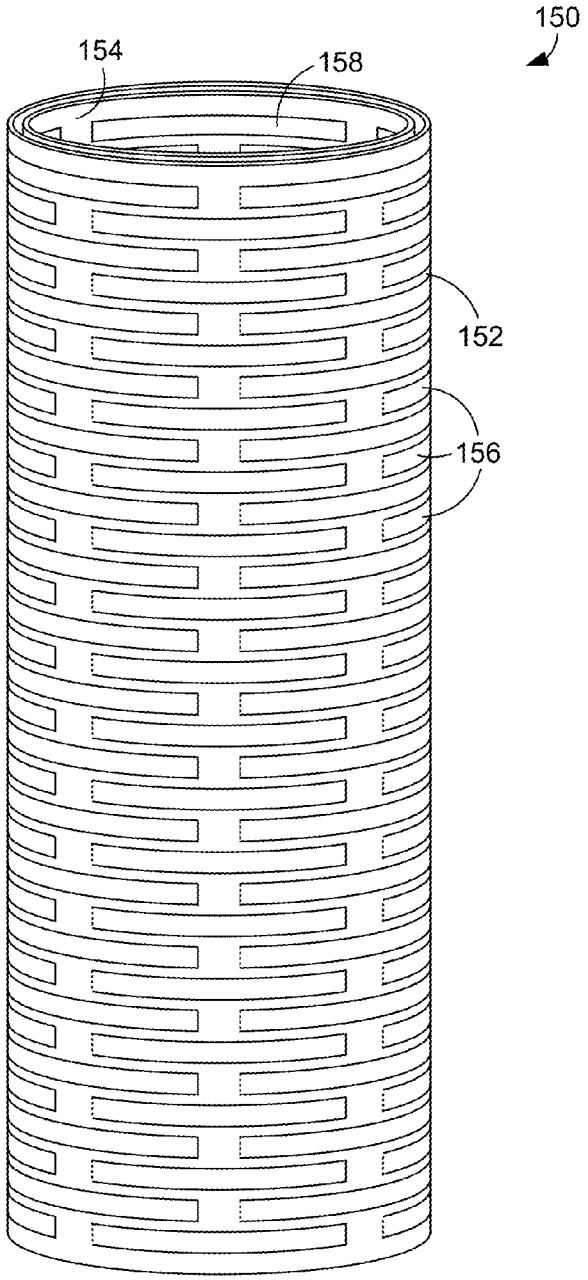
FIG. 11 is a perspective view of an embodiment of a cylindrical variable screen shown prior to actuation.
Figure 12:
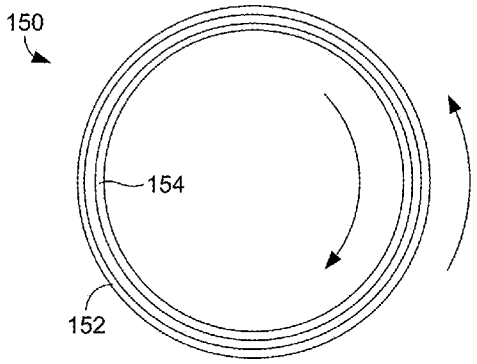
FIG. 12 is an end view of the variable screen of FIG. 11.
Figure 13:
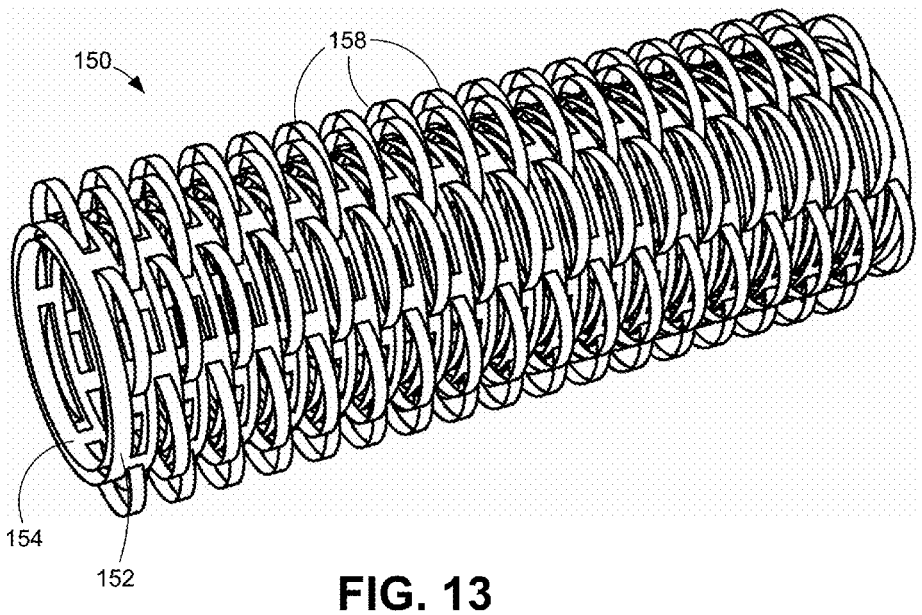
FIG. 13 is a further perspective view of the variable screen of FIG. 11 shown after actuation.

While each of the variable screens described to this point has been planar, it is noted that variable screens need not be flat. As an example, a variable screen can have a tubular configuration, as illustrated in FIGS. 11-13. Beginning with FIG. 11, a tubular variable screen 150 is illustrated. Like the other disclosed variable screens, the screen 150 includes a first panel 152 and a second panel 154. These panels 152 and 154 are similar in nature and function to like-named panels described in relation to FIGS. 1-8. Accordingly, the first panel 152 comprises a plurality of slats 156 that are arranged in rows and columns and the second panel 154 comprises a plurality of corresponding slots 158 that are likewise arranged in rows and columns. Like the other variable screen embodiments, the free ends of the slats 156 are attached to the second panel 154 near ends of the slots to facilitate actuation of the screen 150. In the embodiment of FIGS. 11-13, however, the panels 152, 154 are cylindrical, not planar.

Actuation of the variable screen 150 is illustrated in FIGS. 12 and 13. Relative rotation of the panels 152, 154 in the directions identified by the arrows in FIG. 12 causes the slats 156 to bow radially outward from the first panel as shown in FIG. 13 such that light and/or air can pass through the slots 158 of the second panel 154.

Figure 14A:
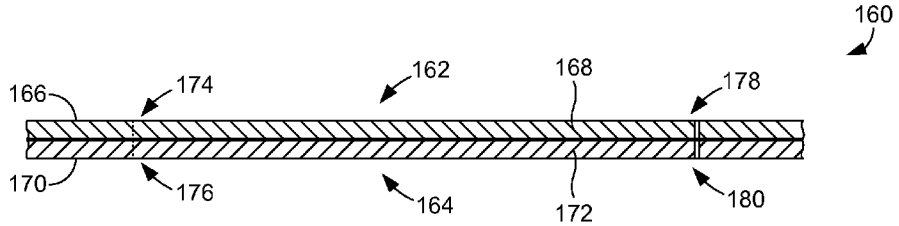
FIG. 14A is a partial cross-sectional side view of a further embodiment of a variable screen.
Figure 14B:
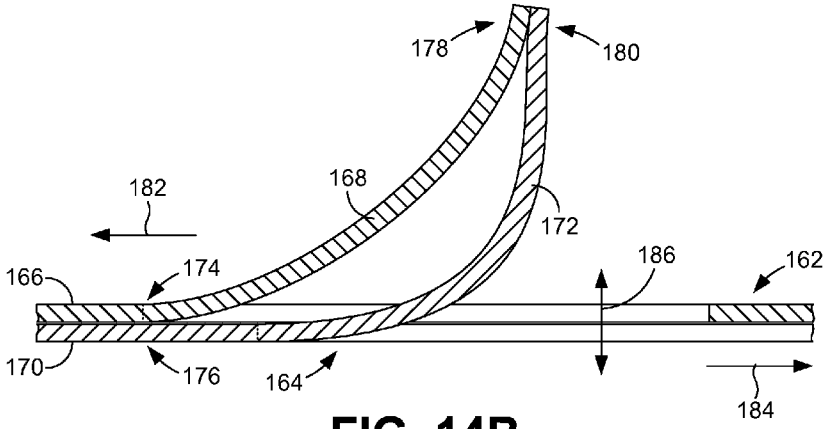
FIG. 14B is a partial cross-sectional side view of the variable screen of FIG. 14A illustrating a first mode of operation of the screen.
Figure 14C:
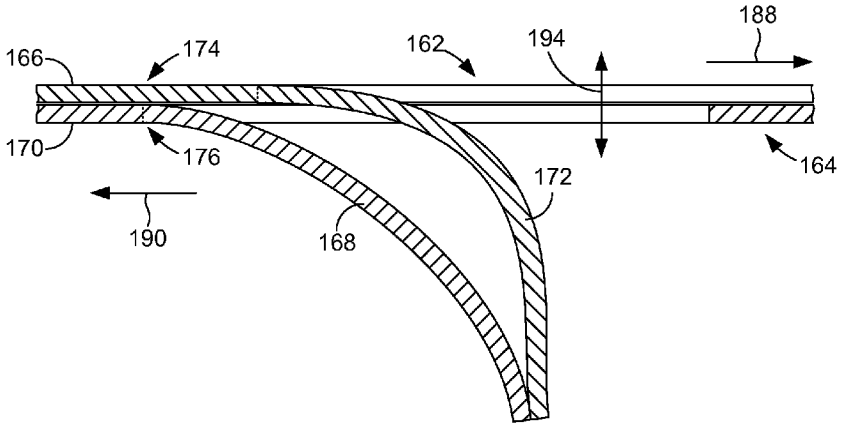
FIG. 14C is a partial cross-sectional side view of the variable screen of FIG. 14A illustrating a second mode of operation of the screen.

FIGS. 14A-14C illustrate a variation on the variable screen embodiments described above. In this variation, a planar variable screen 160 includes substantially identical first (top) and second (bottom) panels 162 and 164. The first panel 162 comprises a substrate 166 in which are formed a plurality of slats 168. In similar manner, the second panel 164 comprises a substrate 170 in which are formed a plurality of slats 172. Each slat 168, 172 includes a proximal fixed end 174, 176 and a distal free end 178, 180. Instead of the free ends 178, 180 of the slats 168, 172 being attached to the opposite panel, the free ends are attached to each other so as to form attached pairs of slats.

With the configuration described above, two forms of actuation are possible. A first form of actuation is illustrated in FIG. 14B. In this example, the first panel 162 is moved to the left (in the orientation of the figure) as indicated by arrow 182 and the second panel 164 is moved to the right (in the orientation of the figure) as indicated by arrow 184 so as to create relative motion (e.g., sliding) between the two panels. This motion causes the slat 168 of the first panel 162 to curl upward and pull the slat 172 of the bottom panel 164 along with it so that both slats are moved upward (in the orientation of the figure). This enables light and/or air to pass through the screen in the directions indicated by arrow 186.

A second form of actuation is illustrated in FIG. 14C. In this example, the first panel 162 is moved to the right (in the orientation of the figure) as indicated by arrow 188 and the second panel 164 is moved to the right (in the orientation of the figure) as indicated by arrow 190 so as to create relative motion (e.g., sliding) between the two panels. This motion causes the slat 172 of the second panel 164 to curl downward and pull the slat 168 of the top panel 162 along with it so that both slats are moved downward (in the orientation of the figure). This enables light and/or air to pass through the screen in the directions indicated by arrow 194.

While the variable screen 160 is depicted in FIG. 14 as being planar, it too can be modified to have a curved (e.g., cylindrical) configuration.

The invention claimed is:

1. A variable screen comprising:

a first panel including elongated slats having a fixed end attached to the panel and a free end not attached to the panel, the slats being flexible so that they can bend without breaking; and a second panel associated with the first panel, the second panel including elongated slots that each align with a respective slat of the first panel;

wherein the free end of each slat is attached to the second panel near an end of each slat's respective slot and wherein relative movement of the panels causes the slats to move from a first orientation in which they are generally parallel with the first panel to a second orientation in which they bow outward from the first panel to enable light or air to pass through the slots.

2. The screen of claim 1, wherein the panels are generally planar.

3. The screen of claim 2, wherein the panels are parallel to each other and the first panel is positioned on top of the second panel.

4. The screen of claim 1, wherein the free ends of the slats are attached to an inner side of the second panel that faces the first panel.

5. The screen of claim 1, wherein the free ends of the slats are attached to an outer side of the second panel that faces away from the first panel.

6. The screen of claim 1, wherein the free ends of the slats are attached to mounting tabs positioned within the slots.

7. The screen of claim 1, wherein the slats bow outward in a direction away from the slots.

8. The screen of claim 1, wherein the slats bow outward through the slots.

9. The screen of claim 1, wherein the free ends of the slats are attached to the second panel with mechanical fasteners.

10. The screen of claim 1, wherein the free ends of the slats are attached to the second panel with adhesive material.

11. The screen of claim 1, wherein the first and second panels are cylindrical and wherein the second panel is concentrically positioned within the outer panel.

12. The screen of claim 11, wherein the slats bow radially outward from the first cylindrical panel.

13. The screen of claim 1, wherein the first panel is placed in contact with the second panel.

14. The screen of claim 13, wherein an inner surface of the first panel contacts an inner surface of the second panel.

15. The screen of claim 1, wherein the slats are in a flat configuration in the first orientation and in a bent configuration in the second orientation.

16. The screen of claim 1, wherein the first panel is are made of a flexible, shape-memory material.

17. The screen of claim 1, wherein the first panel is made of one or more of wood, plastic, and metal.

18. The screen of claim 1, wherein the first panel further includes slots, wherein the slats occupy and close the slots of the first panel when the slats are in the first orientation but exit and open the slots of the first panel when the slats are moved to the second orientation.

* * * * *